United States Patent [19]

Zapf

[11] 3,940,812

[45] Mar. 2, 1976

[54] WELT CONSTRUCTION

[75] Inventor: Otto Zapf, Eschborn, Germany

[73] Assignee: Knoll International, Inc., New York, N.Y.

[22] Filed: Mar. 24, 1975

[21] Appl. No.: 561,302

[52] U.S. Cl. ..... 5/360

[51] Int. Cl.[2] ..... A47C 27/00

[58] Field of Search ..... 5/351, 360, 353.1

[56] References Cited

UNITED STATES PATENTS

| | | | |
|---|---|---|---|
| 2,659,421 | 11/1953 | Wass, et al. | 5/360 |
| 2,359,047 | 9/1944 | Mitchell | 5/360 |

FOREIGN PATENTS OR APPLICATIONS

| | | | |
|---|---|---|---|
| 721,489 | 1/1955 | Great Britain | 5/360 |

*Primary Examiner*—Casmir A. Nunberg
*Attorney, Agent, or Firm*—Cooper, Dunham, Clark, Griffin & Moran

[57] ABSTRACT

A welt construction for joining together two edges of material includes an elongated welt core and upper and lower welt core covers positioned above and below the core. The covers extend beyond each side of the core and are joined together at each side to form a core enclosure. The upper portions of the two sides of the core enclosure are symmetrically joined to the two edges of material to form the welt construction. The various pieces comprising the welt construction may be joined together with parallel rows of stitches, and the edges of material to be joined may be provided with doubled-under end portions which are stitched to the sides of the core enclosure.

3 Claims, 5 Drawing Figures

Fig. 1.
(PRIOR ART)
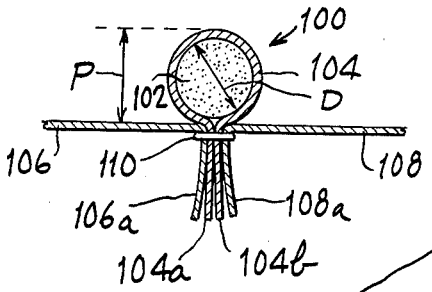
Fig. 2.
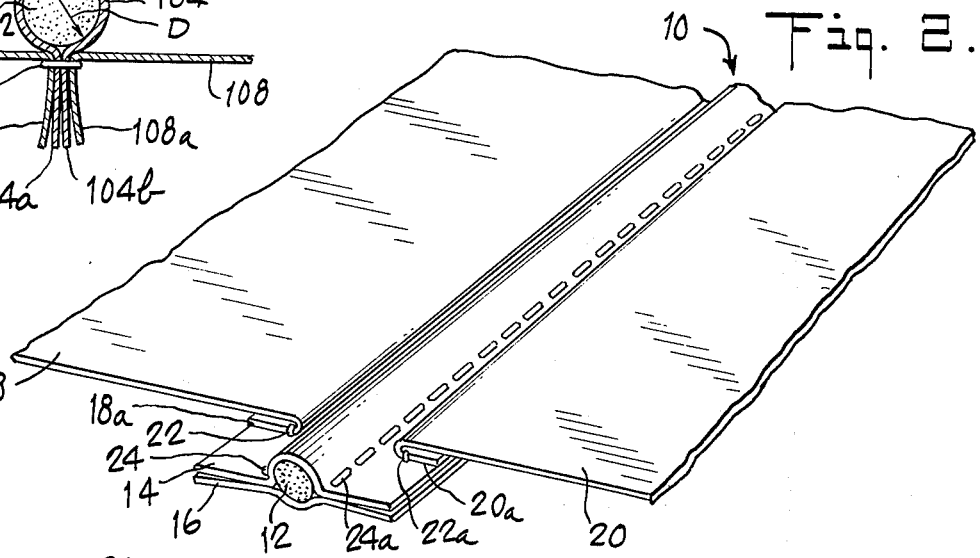
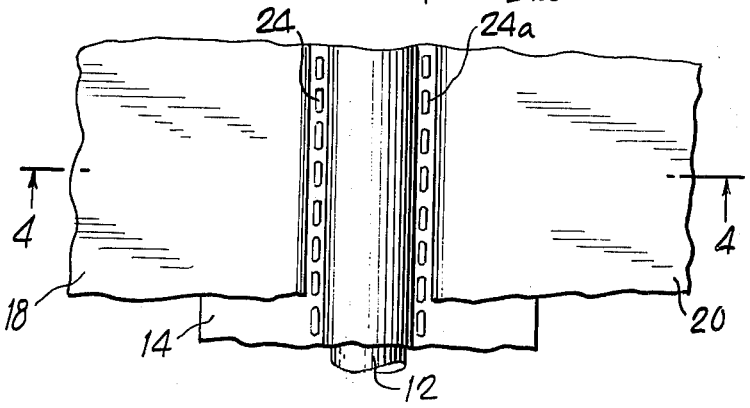
Fig. 3.
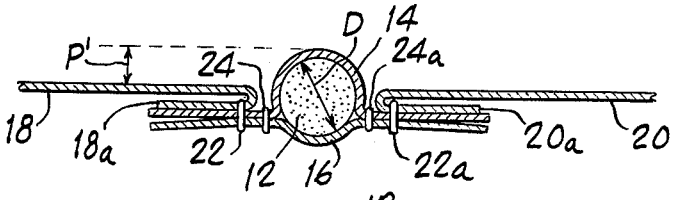
Fig. 4.
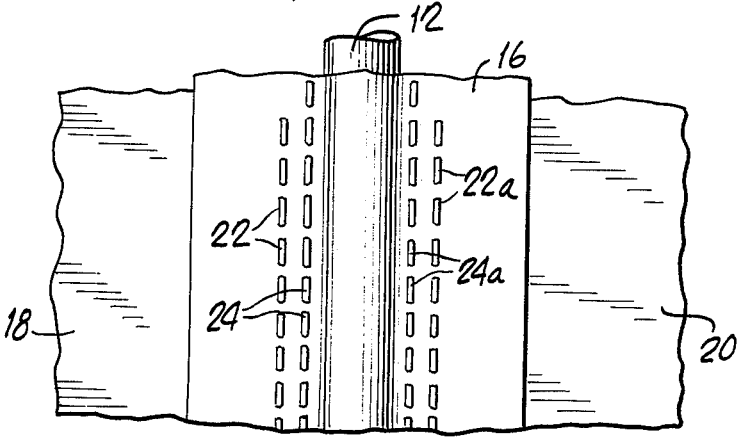
Fig. 5.

WELT CONSTRUCTION

BACKGROUND OF THE INVENTION

This invention relates to a welt construction of the type used for joining together two edges of material. More specifically, the invention relates to a partially-recessed welt construction for joining together two edges of material, each having a doubled-under end portion.

Typical prior art welt constructions are shown in U.S. Patents Nos. 1,941,785 and 2,659,421. In these prior art welts, a one-piece core cover is wrapped around a core so that the cover ends extend away from the welt core at only one point. The edges of material to be joined by the welt are then fastened to the welt cover at the extended portion. This results in a construction in which the welt core and the portion of the cover enclosing the core are positioned entirely above the joined materials. The result is a welt which protrudes substantially from the joined surface, and the larger the diameter of the welt core, the greater the degree of protrusion.

In some applications, it is desirable to employ a relatively thick or large diameter core in order to obtain a massive or "rugged" welt appearance. If a conventional welt construction is employed to attain this appearance, a number of serious disadvantages will result. Since the degree of protrusion in a conventional welt design is proportional to the diameter of the core, as the core is enlarged the finished welt protrudes further from the surface of the materials joined. This protrusion results in a welt configuration which mars the appearance of an otherwise smoothly upholstered cushion or piece of furniture. Furthermore, a large protruding welt is impractical as it is subject to rapid wear and damage, and is uncomfortable to sit on.

The concept of partially recessing the rolled edgings in a mattress is shown in U.S. Patent No. 804,354 and Australian Patent No. 23,708/29. The U.S. Patent shows a roll of material enclosed in a cover and fastened at a single point to the end of a mattress layer. A mattress casing having a deep hem packed with stuffing material is shown in the Australian patent. Neither of these references shows nor suggests the novel welt construction disclosed herein.

SUMMARY OF THE INVENTION

An object of the invention is to provide a welt construction that is massive yet attractive in appearance, simple in design and inexpensive to manufacture.

A further object of the invention is to provide a welt construction for joining two edges of material in which the welt core and core cover are partially recessed with respect to the material being joined.

To these and other ends, the present invention contemplates an elongated welt core with an upper welt core cover positioned above the cover and a lower welt core positioned below the core. The upper and lower core covers extend beyond the sides of the core, and are joined to each other at both sides thereof to form a core enclosure. The upper portions of the two sides of the core enclosure are symmetrically joined to two edges of material being joined, to form the welt construction.

The upper and lower core covers may be joined together at both sides of the core by two inner rows of stitches adjacent to the sides of the core. The two edges of material to be joined by the welt construction may then have doubled-under end portions which can be joined to the upper portions of each side of the core enclosure by two outer rows of stitches. Using this type of construction, the edges of material being joined are positioned substantially above the lowermost portion of the core. This results in a welt in which the core enclosure is partially recessed with respect to the material to be joined, thus permitting the core diameter to be made quite large without having the welt protrude excessively from the surfaces of the joined material.

BRIEF DESCRIPTION OF THE DRAWINGS

FIG. 1 is a perspective view of a prior art welt construction;

FIG. 2 is a perspective view of a welt construction in accordance with the invention;

FIG. 3 is a top view of the welt construction of FIG. 2;

FIG. 4 is a cross-sectional view taken along the line 4–4 in FIG. 3; and FIG. 5 is a bottom view of the welt construction of FIG. 3.

DETAILED DESCRIPTION

A typical prior art welt construction is shown in FIG. 1. A welt 100 is constructed from a welt core 102 surrounded by a one-piece core cover 104. Cover 104 is wrapped around the core and its end portions **104*a* and 104*b* meet and extend away from the lower portion of the core. The ends of material to be joined, shown at 106 and 108 in FIG. 1, have doubled-under edge portions 106*a* and 108*a*, respectively. These end portions are positioned on either side of the end portions 104*a* and 104*b* of the core cover and the four ends are joined together by a row of stitches 110, as shown in FIG. 1**.

This conventional type of welt construction results in a configuration in which the welt core and its surrounding cover protrudes substantially from the surface formed by the materials being joined. While this arragnement is adequate for conventional welts having a small diameter core, it is less suitable for larger diameter welt constructions. This is because the vertical protrusion or height of the welt, shown as the dimension P in FIG. 1, is a direct function of its core diameter D, so that increasing the core diameter causes a proportional increase in welt height. Accordingly, if the core diameter is increased to obtain a more massive or rugged appearance, the welt height becomes so large as to mar the appearance of the welted item. Furthermore, a large-diameter protruding welt is subject to rapid wear and damage, and is unsuitable for use on seating surfaces because it is uncomfortable.

An improved welt construction in accordance with the invention is shown in FIG. 2. A welt construction 10 comprises an elongated welt core 12, an upper welt core cover 14 positioned above the welt core and a lower welt core cover 16 positioned below the welt core. The upper and lower core covers extend beyond the sides of core 12, and are joined together at both sides of the core by parallel inner rows of stitches 24 and 24*a* to form an enclosure for the core.

Welt core 12 may be of any conventional core material, such as rope, soft plastic, or the like. Similarly, core covers 14 and 16 may be of any suitable upholstering material, such as fabric, vinyl or leather, and the rows of stitches may be of conventional upholstering thread of suitable gauge.

Two edges of material to be joined, shown at 18 and 20 in FIG. 2, have doubled-under end portions 18*a* and 20*a*, respectively. These doubled-under end portions are symmetrically joined to the two upper side portions of the core enclosure. As shown in FIG. 2, the doubled-under end portions may be joined to the upper portions of the core enclosure by parallel outer rows of stitches 22 and 22*a*.

In the top view of FIG. 3, it can be seen that while inner rows of stitches 24 and 24*a* are visible in the completed welt construction, outer rows of stitches 22 and 22*a*, which actually join the edges of material 18 and 20 to the welt core covers, are not visible. Additionally, a small portion of upper welt core cover 14 on either side of the inner rows of stitches is visible. This arrangement permits a great variety of attractive visual effects to be achieved without in any way altering the basic structure of the welt. For example, upper welt core cover 14 may be of either a matching or contrasting color or texture from that of the materials being joined. The edges of material 18 and 20 may be a light colored rough canvas material while the upper welt core cover 14 may be a contrasting dark, smooth leather or vinyl material. The visible inner rows of stitches 24 and 24*a* can be made with either light or dark thread. Thus, a great variety of attractive and interesting configurations may be fabricated using the basic welt construction. Furthermore, the visible rows of stitches and visible side portions of the upper welt core cover serve to enhance the overall appearance of the finished product by adding a rugged, hand-crafted appearance to the welt.

The partial recessing of welt core 12 and its associated upper core cover 14 is shown in the cross-sectional view of FIG. 4. In contrast to the prior art welt construction of FIG. 1, discussed above, the welt core is no longer positioned entirely above the edges of material being joined. In the embodiment shown in FIG. 4, for example, edges of material 18 and 20 are positioned at about the same level as the mid-point of core 12. By thus recessing the core and core cover, the outward protrusion P′ of the core cover in FIG. 4 is substantially less than the corresponding protrusion P of the conventional welt construction of FIG. 1, although the core diameter D is the same in both cases.

Using the disclosed configuration, a welt has been constructed with a core diameter D of about ¼ inch and a protrusion P′ of less than about ⅛ inch. A conventional welt having a ¼ inch core diameter D would necessarily have a protrusion P of greater than ¼ inch. Furthermore, the outward profile of the core cover in FIG. 4 is basically semicircular, and thus presents a smoother, more satisfying visual appearance than that of the circular "tacked on" appearance presented by the prior art configuration of FIG. 1. The visibility of stitching rows 24 and 24*a* and a portion of the side surfaces of the core cover adds to this visual effect.

By partially recessing the welt core and core cover, it becomes feasible to increase the diameter of the welt core without obtaining a fragile, unattractive and uncomfortable protrusion. Furthermore, as the welt core diameter is increased, the core may easily be further recessed, simply by having lower core cover 16 extend around a larger portion of the circumference of core 12 and by having upper core cover 14 extend around a correspondingly smaller portion of the circumference of core 12. The net effect of this change would be to further recess core 12 with reference to the side surfaces of upper core cover 14 and thus further reduce the degree of welt protrusion.

In FIGS. 4 and 5, it may be seen that all of the unfinished edges of the upper and lower core covers 14 and 16, as well as the unfinished edges of the doubled-under end portions 18*a* and 20*a*, are positioned below the visible surface of the welt, thus resulting in a smooth, finished appearance without the necessity for finishing the edges. Similarly, outer rows of stitches 22 and 22*a*, shown in FIG. 5, are visible only on the underside of the welt.

It should be noted that the seams discussed above need not be made from rows of stitches. For example, a welt constructed of vinyl or other plastic material might be more economically joined by the use of an appropriate adhesive or a thermal joining process, rather than by stitchng. A further simplification of the basic welt construction may be obtained by not doubling-under the end portions of materials 18 and 20 before joining these materials to the sides of the core covers. Although this would simplify the joining operation, it has the disadvantage of exposing the unfinished end portions of materials 18 and 20 and would also expose the outer rows of stitches, which may be undesirable from a visual standpoint. Furthermore, the doubled-under end portions, shown at 18*a* and 20*a* in FIG. 4, serve to further recess the core and core enclosure by an additional thickness of material. Thus, in core construction shown in FIG. 4, the edges of material to be joined are positioned above the lowermost portion of the core by at least one thickness of upper core cover material and one thickness of the doubled-under material. Accordingly, if the edges of material being joined are not doubled under, the minimum degree of recessing is reduced to a single thickness of material. However, this is not a serious drawback, since further adjustment in the degree of recessing may be achieved by adjusting the portions of core circumference covered by the upper and lower core covers, as discussed above.

While the invention has been particularly shown and described with reference to a preferred embodiment thereof, it will be understood by those skilled in the art that various changes in the form and details may be made therein without departing from the spirit and scope of the invention.

I claim:

1. A partially-recessed welt construction for joining together two edges of material, which comprises:
   an elongated welt core;
   an upper welt core cover positioned above said welt core and a lower welt core cover positioned therebelow, said covers extending beyond each side of said core;
   means for joining said welt core covers together at both sides of said core to form an enclosure therefor; and
   means for symmetrically joining the upper portion of each side of said core enclosure to an edge of said material to be joined, the edges of material so joined being positioned above the lowermost portion of said core by at least one thickness of upper core cover material, thereby to partially recess said core enclosure with respect to the joined edges of material.

2. A welt construction as in claim 1, wherein the means for joining said welt core covers together at both sides of said core comprises an inner row of stitches adjacent to each side of said core, said rows of stitches being substantially parallel to each other and to said core, and the means for symmetrically joining the upper portion of each side of said core enclosure to an edge of said material to be joined comprises:
   a doubled-under end portion on each edge of said material to be joined;
   an outer row of stitches to join the upper portion of each side of said core enclosure to one doubled-under end portion, said outer rows of stitches being substantially parallel to said inner rows of stitches and positioned further apart from said core than said inner rows.

3. A partially-recessed welt construction for joining together two edges of material, which comprises:
   an elongated welt core;
   an upper welt core cover positioned above the core and a lower welt core cover positioned below the core, said core covers extending beyond the sides of the core and said covers being joined together at both sides of the core by two substantially parallel inner rows of stitches, said rows of stitches each being adjacent to one side of said core, to form an enclosure therefor;
   a doubled-under end portion at each edge of material to be joined; and
   a pair of outer rows of stitches to symmetrically join the doubled-under end portions of the two edges of material to the upper portion of the core covers, the outer rows of stitches each being substantially parallel to said inner rows of stitches and positioned further from said core than said inner rows, and said outer stitches each joining one doubled-under end portion of said material to the upper portion of the previously-joined core covers on each side of said core, the edges of material so joined being positioned above the lowermost portion of said core by at least one thickness of upper core cover material and one thickness of doubled-under material to partially recess said core enclosure with respect to the joined material.

* * * * *